US006146090A

United States Patent [19]

Schmidt

[11] Patent Number: 6,146,090

[45] Date of Patent: Nov. 14, 2000

[54] COOLING/HEATING AUGMENTATION DURING TURBINE STARTUP/SHUTDOWN USING A SEAL POSITIONED BY THERMAL RESPONSE OF TURBINE PARTS AND CONSEQUENT RELATIVE MOVEMENT THEREOF

[75] Inventor: Mark Christopher Schmidt, Niskayuna, N.Y.

[73] Assignee: General Electric Co., Schenectady, N.Y.

[21] Appl. No.: 09/218,228

[22] Filed: Dec. 22, 1998

[51] Int. Cl.[7] ..... F01D 5/08; F01D 17/08

[52] U.S. Cl. ..... 415/47; 415/48; 415/116; 415/117; 415/175; 415/176; 415/178; 416/39; 416/96 R; 416/96 A; 416/198 A; 416/201 R

[58] Field of Search ..... 415/47, 48, 115, 415/116, 117, 175–178, 134, 136, 138; 416/39, 95, 96 R, 96 A, 97 R, 198 A, 200 A, 201 R

[56] References Cited

U.S. PATENT DOCUMENTS

| | | | |
|---|---|---|---|
| 3,736,069 | 5/1973 | Beam, Jr. et al. | 415/175 |
| 3,736,751 | 6/1973 | Fuller | 415/116 |
| 4,379,677 | 4/1983 | Hallinger et al. | 415/138 |
| 4,554,789 | 11/1985 | Napoli et al. | 415/176 |
| 4,613,280 | 9/1986 | Tate | 415/176 |
| 4,730,982 | 3/1988 | Kervistin | 416/198 A |
| 4,880,354 | 11/1989 | Teranishi et al. | 416/198 A |

FOREIGN PATENT DOCUMENTS

| | | | |
|---|---|---|---|
| 1381277 | 1/1975 | United Kingdom | 415/115 |

*Primary Examiner*—Christopher Verdier
*Attorney, Agent, or Firm*—Nixon & Vanderhye

[57] ABSTRACT

In a turbine rotor, a thermal mismatch between various component parts of the rotor occurs particularly during transient operations such as shutdown and startup. A thermal medium flows past and heats or cools one part of the turbine which may have a deleterious thermal mismatch with another part. By passively controlling the flow of cooling medium past the one part in response to relative movement of thermally responsive parts of the turbine, the flow of thermal medium along the flow path can be regulated to increase or reduce the flow, thereby to regulate the temperature of the one part to maintain the thermal mismatch within predetermined limits.

4 Claims, 2 Drawing Sheets

COOLING/HEATING AUGMENTATION DURING TURBINE STARTUP/SHUTDOWN USING A SEAL POSITIONED BY THERMAL RESPONSE OF TURBINE PARTS AND CONSEQUENT RELATIVE MOVEMENT THEREOF

This invention was made with Government support under Contract No. DE-FC21-95MC31176 awarded by the Department of Energy. The Government has certain rights in this invention.

TECHNICAL FIELD

The present invention relates generally to turbines and particularly to land-based gas turbines for power generation. More particularly, the present invention relates to tuning the thermal mismatch between rotor parts, for example, a turbine wheel and an aft shaft wheel during transient operations by controlling flow of a thermal medium along one of such parts using a self-positioning thermally responsive seal.

BACKGROUND OF THE INVENTION

In a typical gas turbine, the turbine rotor is formed by stacking rotor wheels and spacers, the stacked plurality of wheels and spacers being bolted one to the other. Rabbeted joints are typically provided between the spacers and wheels. In more advanced gas turbines, cooling circuits are provided through the rotor for cooling the buckets. For example, cooling steam may be provided through an aft shaft forming part of the rotor assembly for flow along the rim of the rotor to the buckets of one or more of the turbine stages to cool the buckets. Spent cooling steam also flows from the buckets in a return path along the rim of the rotor and through the aft shaft.

BRIEF SUMMARY OF THE INVENTION

With the stack-up of rotor wheels and spacers, and with varying temperatures being applied to various rotor elements at different times during operation of the turbine, i.e., startup, steady-state operation and shutdown, thermal mismatch between turbine rotor elements may be of sufficient magnitude during particular phases of turbine operation to cause relative movement of such elements with resultant deleterious effects. For example, thermal mismatch between a rotor wheel and an adjoining spacer may open the rabbeted joints therebetween. This mismatch occurs particularly in the present advanced gas turbine design because steam cooling circuits are provided in the aft shaft and aft shaft wheel, the latter mating with the wheel of the last turbine stage, e.g., the fourth stage. It will be appreciated that during steady-state turbine operation, thermal mismatch between elements of the turbine rotor and particularly between the aft shaft and the last-stage wheel lies within a predetermined acceptable range. The thermal response within that range is insufficient to cause relative movement between the wheels and spacers or the aft shaft and last-stage wheels, and hence the rabbeted joints do not shift or open up. Thus, at steady-state operation, there is no relative movement of the turbine rotor parts which otherwise could cause the rotor to lose balance, possibly leading to high vibrations and a need for rebalancing or rotor replacement at substantial cost.

During turbine shutdown, however, hot gases of combustion no longer flow through the hot gas path and, in a relatively short period of time, approximately one hour, the turbine slows from 3000 rpm to 7 rpm. It will be appreciated that with only marginal flow through the turbine at this low rpm, with the steam cooling circuits shut down, and the relatively large mass of the turbine wheel, the temperature of the turbine wheel decreases at a substantially slower rate than the temperature decrease of the aft shaft, causing a thermal mismatch between those elements. A thermal mismatch of as much as 280° F. between these elements has been demonstrated during turbine shutdown. A large thermal mismatch such as this can unload the rabbeted joints and cause relative movement between the elements. Over time, of course, the thermal mismatch decreases until there is substantial thermal equilibrium between these elements.

Likewise, at startup of the turbine, thermal mismatches occur between various rotor elements. For example, at startup, the hot gas flowing through the hot gas path of the turbine heats up the last-stage turbine wheel very slowly because of its large mass. Conversely, the aft shaft and aft shaft wheel which convey the cooling medium, initially air and subsequently steam, heat up rather rapidly, causing a thermal mismatch between the aft shaft and last-stage wheels. This again may cause the rabbeted joint between these elements to open, resulting in the potential for an unbalanced rotor.

Different ways of controlling the thermal response of turbine rotor parts have been considered. In accordance with an embodiment of the present invention, a seal is provided to control the flow of a thermal medium in accordance with the thermal response and consequent relative movement of turbine parts during transient operations. That is, the relative position of the turbine parts at the location of the seal controls the flow of the thermal medium to the potentially thermally mismatched parts during turbine startup and shutdown. For example, during turbine shutdown, when the last-stage wheel cools slowly in relation to the aft shaft wheel, the seal is located in a thermal medium flow passage to reduce the cooling effect of the flowing thermal medium on the aft shaft wheel, thereby reducing the thermal mismatch between the last-stage wheel and the aft shaft wheel. Particularly, by flowing a thermal medium past a surface of the aft shaft wheel and reducing the flow rate of the thermal medium as a result of the inherent thermally responsive relative movement of turbine parts, the thermal mismatch can be reduced during shutdown. By locating a seal, for example, between the exhaust frame and aft shaft wheel in the flow passage for a thermal medium in heat transfer relation with the aft shaft wheel, the relative movement of the exhaust frame and rotor during shutdown causes the seal to reduce the flow of thermal medium. This reduces the thermal mismatch between the aft shaft wheel and fourth-stage wheel during shutdown. It will be appreciated that the seal itself has no moving parts and is responsive passively to control the flow of the thermal medium.

Conversely, and during startup, the same seal increases the flow of thermal medium to cool the less massive, and hence more readily heated, turbine part to maintain its thermal mismatch with an adjacent turbine part within a predetermined thermal mismatch. Particularly, the seal located between the exhaust frame and the turbine rotor opens the flow passage of the thermal medium through the forward closure plate cavity whereby increased flow occurs, slowing the rate of heat build-up in the aft shaft wheel, so that the thermal mismatch between that wheel and the fourth-stage wheel is maintained within predetermined limits.

In a preferred embodiment according to the present invention, there is provided a turbine, comprising first and second parts defining a flow path in the turbine for flowing a thermal medium, the parts having different thermal responses to applied temperatures generating relative movement between the parts, a seal carried by the first part and in the flow path, the seal being responsive to the relative movement between the parts to regulate the flow of the thermal medium along the flow path, thereby increasing or reducing the flow of thermal medium along the flow path to regulate the temperature of one of the parts.

In a further preferred embodiment according to the present invention, there is provided a turbine, comprising first and second parts defining a flow path in the turbine for flowing a thermal medium, the parts having different thermal responses to applied temperatures generating relative movement between the parts, a seal carried by one of the parts and in the flow path, a third part connected to the second part and responsive to different temperatures applied thereto creating a thermal mismatch therebetween, the seal being responsive to the relative movement between the first and second parts to regulate the flow of the thermal medium along the flow path past the seal, thereby regulating the temperature of the third part enabling the thermal mismatch between the second and third parts to lie within a predetermined range.

In a still further preferred embodiment according to the present invention, there is provided in a turbine having first and second parts defining a flow path for flowing a thermal medium, the parts having different thermal responses to applied temperatures generating relative movement between the parts, a method of regulating the temperature of one of said parts comprising the step of passively regulating the flow of the thermal medium along the flow path in response to the relative movement between the parts to increase or decrease the flow thereby regulating the temperature of said one part.

Accordingly, it is a primary object of the present invention, to provide apparatus and methods for augmenting cooling/heating turbine parts during turbine transient operating conditions, i.e., during shutdown/startup using a seal positioned by thermally responsive relative movement of turbine parts thereby passively controlling the supply of heating or cooling medium to a surface of one of the elements and hence controlling the thermal mismatch between the parts.

DETAILED DESCRIPTION OF THE INVENTION

Figure 1:
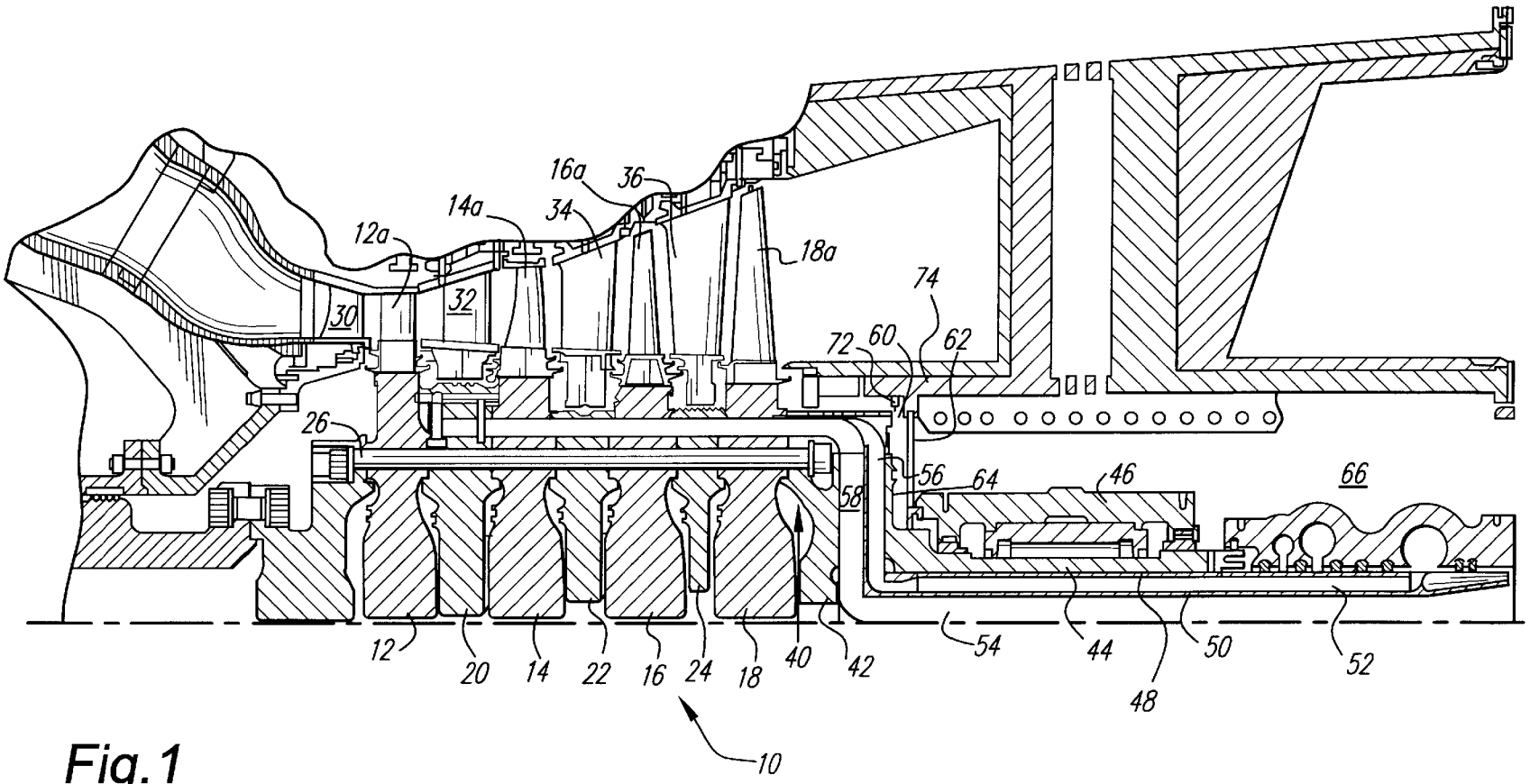
FIG. 1 is a fragmentary cross-sectional view of a portion of a turbine illustrating a preferred manner of tuning the thermal response of a pair of turbine elements.
Figure 3:
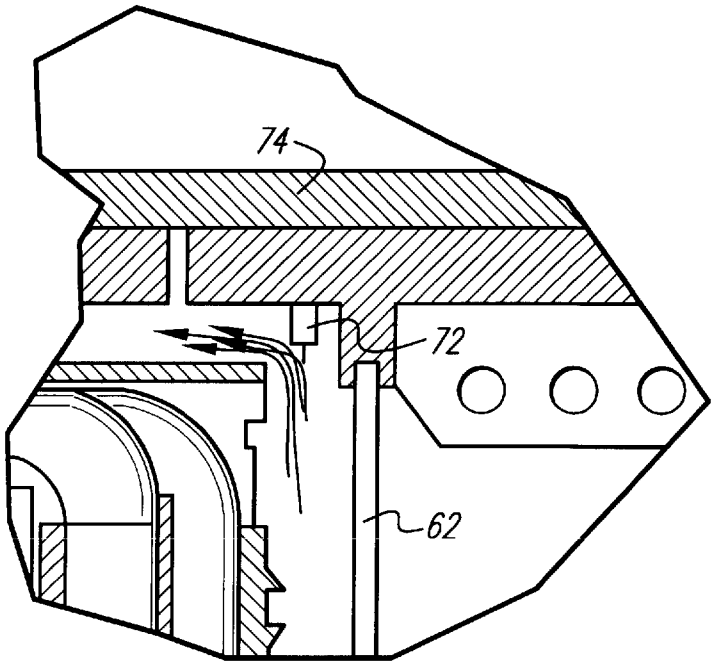
FIGS. 2 and 3 are enlarged illustrations of the passive seal hereof in different relative positions during turbine shutdown and startup, respectively.
Figure 2:
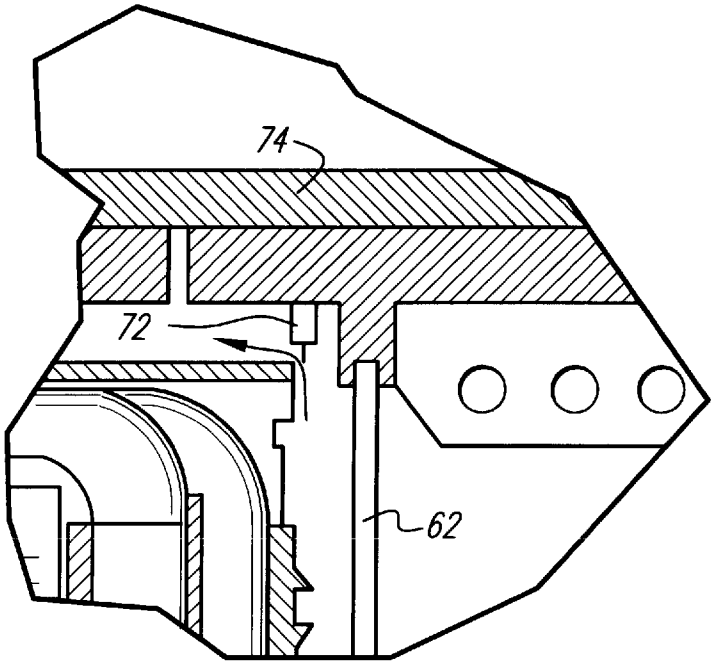

Referring to FIG. 1, there is illustrated a portion of a turbine including a turbine rotor, generally designated 10, comprised of stacked elements, for example, rotor wheels 12, 14, 16 and 18, which form portions of a four-stage exemplary turbine rotor, with spacers 20, 22 and 24 alternating between the wheels. It will be appreciated that the wheel and spacer elements are held together in the rotor by a plurality of elongated, circumferentially extending bolts, only one of which is illustrated, at 26. The wheels 12, 14, 16 and 18 mount a plurality of circumferentially spaced turbine buckets 12*a*, 14*a*, 16*a* and 18*a*, respectively. Nozzles 30, 32, 34 and 36 form stages with the buckets 12*a*, 14*a*, 16*a* and 18*a*, respectively. Note that the wheels and spacers lie in axial registration one with the other and that rabbeted joints are provided between the wheels and spacers. An exemplary rabbeted joint, designated 40, is illustrated between the last-stage wheel 18 and an aft shaft wheel 42 forming part of an aft shaft 44. The rabbeted joints are maintained locked to one another throughout all ranges of operation of the turbine. As illustrated, the aft shaft 44 is rotatable with the rotor 10 within an aft bearing 46 surrounded by aft bearing cavity 66.

In an advanced gas turbine design of the assignee hereof, the aft shaft 44 houses a bore tube assembly described and illustrated in detail in co-pending U.S. patent application Ser. No. 09/216,363 (Attorney Docket No. 839-540). The bore tube assembly, in general terms, includes outer and inner tubes 48 and 50, respectively, defining an annular steam cooling passage 52 and a spent steam cooling return passage 54. The passages 52 and 54 communicate steam to and from the outer rim of the rotor through sets of radially extending bores or conduits 56 and 58, respectively, which in turn communicate with longitudinally extending tubes spaced about the rim of the rotor. Suffice to say, the steam supplied through the steam passage 52 and bores 56 supply cooling steam to buckets of the first and second stages, while the bores 58 and return passage 54 receive the spent cooling steam from the buckets for return.

As previously mentioned, thermal mismatches between various elements of the rotor occur during operation of the turbine, particularly during shutdown and turbine startup. During steady-state turbine operations, the temperature distribution among the various elements of the turbine lies within a predetermined range of thermal mismatch which would not deleteriously affect the operation of the turbine. However, during transient operations, i.e., shutdown and startup, thermal mismatches are significantly greater and must be accommodated. For example, the rabbeted joint 40 between the aft shaft wheel 42 and the wheel 18 of the final, e.g., fourth stage has during transient operations a significant thermal mismatch well beyond an acceptable thermal mismatch and which may cause an open or unloaded rabbet. That is, such condition could cause the elements to move relative to one another and thus cause the rotor to lose balance, leading to high vibrations and a requirement for costly rebalancing or rotor replacement.

More particularly, during shutdown, the hot gases flowing through the hot gas path of the various turbine stages and the flow of steam through the bore tube cooling circuit assembly are terminated. Because the wheel 18 has a very large mass and has been heated to a high temperature during steady-state operation of the turbine, wheel 18 will lose heat at a very slow rate in comparison with the heat loss in the aft shaft wheel 42, causing a large thermal mismatch at the rabbeted joint 40. As noted previously, the thermal mismatch can be as large as 280° F., which could cause the rabbet to open. Similarly, a large thermal mismatch occurs at startup. At startup, the wheel 18 is cool and it acquires heat relatively slowly from the hot gas path in comparison with the rate of increase of heat absorbed in the aft wheel 42 by the flow of the cooling medium, e.g., air initially and thereafter cooling steam, through the passages 52, 54 and bore tubes 56 and 58. Thus, a substantial thermal gradient or thermal mismatch occurs between these two elements during transient conditions, i.e., the wheel 18 having an elevated temperature in comparison with the aft wheel 42 during shutdown, while the aft wheel 42 has an elevated temperature in comparison with the wheel temperature 18 during startup.

A thermal medium is supplied the cavity 60 between the forward closure plate 62 and the aft surface of the aft shaft wheel 42. The thermal medium may be supplied from a suitable source and flows past the radial surface of the aft shaft wheel and outwardly into the hot gas path aft of the last stage.

To passively control the flow of the thermal medium and hence reduce thermal mismatch during transient phases of turbine operation, there is provided an annular seal 72 between turbine parts which have different thermal responses to applied temperatures generating relative movement between the parts. In the illustrative example, the seal 72 is located in the flow path of the thermal medium downstream of the cavity 60 and on one or the other of the rotor 10 or exhaust frame 74. It will be seen that the seal 72 enlarges or reduces the annular opening between such parts in response to relative axial movement of the exhaust frame and rotor. During shutdown, for example, when the last-stage wheel 18 cools more slowly than the aft shaft wheel 42, it is desirable to reduce the flow of thermal medium flowing past the aft shaft wheel 42, thereby reducing the rate of cooling of the aft shaft wheel to that more closely corresponding to the rate of cooling of the wheel 18. During shutdown, the thermal response of the exhaust frame and rotor causes relative movement thereof in a direction(s) closing the annular opening therebetween. By closing the opening, the seal 72 reduces the flow rate of cooling medium past the aft shaft wheel slowing the rate of cooldown of the aft shaft wheel. In this manner, the thermal mismatch between the aft shaft wheel and the fourth-stage wheel is maintained within predetermined limits. That is, the thermal mismatch, when maintained within such limits, does not cause relative movement between the aft shaft wheel 42 and fourth-stage wheel 18 which might otherwise open the rabbeted joint during shutdown. Consequently, an acceptable thermal mismatch is maintained.

Conversely, during startup, when the aft shaft wheel is heated at a faster rate than the last-stage wheel is heated, it is desirable to increase the flow of thermal medium along the aft shaft wheel surface to slow its rate of heat increase. That is, during startup, the thermal response of the exhaust frame and rotor causes relative movement thereof in direction(s) opening the annular opening therebetween. The opening of the flow passage increases the cooling effect of the thermal medium applied to the aft shaft wheel, thereby reducing the thermal mismatch between the aft shaft wheel and last-stage wheel during startup. Once steady-state operation of the turbine is obtained, the thermal mismatch is maintained within acceptable limits due to substantial temperature equilibrium between the parts, i.e., the wheel 18 and aft shaft wheel 42. Thus, by disposing a seal 72 in a thermal medium flow path between turbine parts, e.g., first and second parts 74 and 42, which have different thermal responses to applied temperatures, the relative movement between said parts causes the seal to control the flow along the flow path and thereby regulate the temperature of the second part to maintain the thermal mismatch between the second part and a third part, e.g., aft shaft wheel 42, to within a predetermined mismatch.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine, comprising:

first and second parts defining a flow path in the turbine for flowing a thermal medium, said parts having different thermal responses to applied temperatures generating relative movement between said parts;

a seal carried by one of said first and second parts and in said flow path;

said seal being responsive to said relative movement between said parts to regulate the flow of the thermal medium along said flow path, thereby increasing or reducing the flow of thermal medium along the flow path to regulate the temperature of said second part;

wherein said second part and a third part are connected to one another and are responsive to different applied temperatures creating a transient thermal mismatch therebetween, said seal regulating the flow of thermal medium along said flow path to either heat or cool said second part to a temperature enabling the magnitude of the thermal mismatch of said second part and said third part to lie within a predetermined thermal mismatch; and wherein said third part comprises a turbine rotor wheel for mounting buckets and said second part comprises an adjoining wheel having a rabbeted joint with said turbine rotor wheel, said adjoining wheel being heated or cooled to reduce the thermal mismatch between said turbine rotor wheel and said adjoining wheel to within a predetermined thermal mismatch to preclude relative displacement of the rabbeted joint therebetween.

2. A turbine according to claim 1 wherein said seal reduces flow along said flow path in response to movement of one of said first and second parts toward another of said first and second parts to reduce heat transfer from one or another of said parts to said thermal medium.

3. A turbine according to claim 1 wherein said seal increases flow along said flow path in response to movement of one of said first and second parts away from another of said first and second parts to promote heat transfer from one or another of said parts to said thermal medium.

4. A turbine according to claim 1 wherein said first and second parts comprise stationary and rotating components of the turbine, respectively.

* * * * *